US007003910B2

(12) United States Patent
Sharp

(10) Patent No.: US 7,003,910 B2
(45) Date of Patent: Feb. 28, 2006

(54) ATTACHMENT PLATE OF A FLEXIBLE, BENDABLE MATERIAL

(75) Inventor: Kenneth Sharp, Skarholmen (SE)

(73) Assignee: Novus Innovation Inc., Phoenix, AZ (US)

( * ) Notice: Subject to any disclaimer, the term of this patent is extended or adjusted under 35 U.S.C. 154(b) by 0 days.

(21) Appl. No.: 10/757,110

(22) Filed: Jan. 14, 2004

(65) Prior Publication Data

US 2004/0194359 A1 Oct. 7, 2004

(30) Foreign Application Priority Data

Apr. 1, 2003 (SE) ..... 0300942

(51) Int. Cl.
*G09F 3/16* (2006.01)

(52) U.S. Cl. ..... 40/673; 40/315; 40/666

(58) Field of Classification Search ..... 40/1.5, 40/1.6, 315, 316, 673, 607.15, 607.13, 645, 40/666; 24/67.9, 545, 563, 30.5 S; D20/22, D20/27; 248/222.11, 222.12

See application file for complete search history.

(56) References Cited

U.S. PATENT DOCUMENTS

| | | | | |
|---|---|---|---|---|
| 2,609,629 | A * | 9/1952 | Hubbard | 40/1.5 |
| 2,756,525 | A * | 7/1956 | Greenberger | 40/315 |
| 3,776,415 | A * | 12/1973 | Pfeffer | 220/701 |
| 5,406,726 | A * | 4/1995 | Fan | 40/1.6 |
| 6,216,377 | B1 * | 4/2001 | Painsith | 40/750 |

FOREIGN PATENT DOCUMENTS

GB 90 16 614.0 12/1990

* cited by examiner

*Primary Examiner*—Brian K. Green
(74) *Attorney, Agent, or Firm*—Rolf Fasth; Fasth Law Offices

(57) ABSTRACT

The attachment plate (2) is made of a flexible, bendable material. The attachment plate has two tongue shaped portions including a first tongue and a second tongue formed by a perforation in the plate so that a foot portion of each tongue shaped portion is held to the plate while each respective tongue shaped portion, extending from the foot portion to an outer free end of each tongue shaped portion, respectively, is outwardly bendable from the plate and the outer free ends of the tongue shaped portions are immediately adjacent to one another at a slit formed by a perforation.

10 Claims, 1 Drawing Sheet

ATTACHMENT PLATE OF A FLEXIBLE, BENDABLE MATERIAL

PRIOR APPLICATION

This application claims priority from Swedish Application No. 0300942-0, filed 1 Apr. 2003.

TECHNICAL FIELD

The present invention relates to an attachment plate of a flexible, bendable material that is adapted for attachment to fabric, cables, flower stalks or similar items.

BACKGROUND

Signs, cards, card holders and plates with attachment arrangement for attachment to clothing are previously known. A couple of known attachment arrangements for a sign are for example the commonly used name badges used at exhibitions, conferences, courses and stores or similar applications. An attachment arrangement for such a name tag is usually in the form of a safety pin, clip or needle with an attachment plate (so called pin) arranged on a backside of the plate. These tags should quickly and easily be attached to clothing of the bearer and be removable in an uncomplicated way without damaging the clothing at the attachment points. When making such name tags the attachment arrangement must be attached to the tag and also extend along the backside of the tag.

DE-U1-9016614 shows a card of paper with a cavity that is adapted to be attached to an item such as a button. The card includes a U-shaped slit in which a business card can be inserted and held therein.

A problem with the above publication is that the actual attachment arrangement of the card/sign limits the area of use i.e. which type of items the card/sign can be attached to and that portions of the item to which the sign or card is attached to extend on the front side of the card/sign.

SUMMARY OF THE INVENTION

One object of the present invention is to provide a sign/plate with an attachment arrangement that at least partially eliminates the drawbacks that are associated with the arrangements of the prior art. An additional object is to provide a sign/plate with an attachment arrangement that is easy to attach to different types of items and can be produced at a low cost. A further object is to provide a sign/plate with an attachment arrangement that only substantially extends in an extension plane. The sign/plate does not have an attachment arrangement that substantially extends across the extension plane of the sign/plate and that prevents portions of the item, to the side to which the sign/plate is attached, to extend on the second opposite side of the sign.

The object is achieved by an attachment plate of a flexible, bendable material adapted for attachment to fabric, cables, flower stalks or similar items according to the present invention as defined in patent claim 1. The attachment plate has two tongue-shaped portions including a first tongue and a second tongue formed by a perforation in the plate so that a foot portion of each tongue-shaped portion is held to the plate while each respective tongue-shaped portion, extending from the foot portion to an outer free end of each tongue-shaped portion, respectively, is outwardly bendable from the plate and the outer free ends of the tongue-shaped portions are immediately adjacent to one another at a slit formed by a perforation. The outer free end of each respective tongue shaped portion has at least one narrowing portion so that each respective narrowing portion is adapted to at least partially overlap the other narrowing portion at the slits.

The attachment plate of the present invention can be a name tag, a business card or a card in the form of a credit card or a similar item. The tongue-shaped portions and the slit disposed therebetween is the actual attachment mechanism of the attachment plate.

An advantage with this solution according to the present invention is that the attachment arrangement is integrated into the attachment plate and that the attachment plate substantially extends only in the extension plane of the plate. An advantage of the present invention is thus that the attachment plate eliminates the need for applying a separate attachment mechanism to the plate. The attachment mechanism of the attachment plate is shaped so that it can be attached to items with varied shapes and dimensions such as fabric/clothing, a cable, flower stalk etc. Yet another advantage is that the attachment plate makes it possible to produce the plate at a low manufacturing cost.

Different areas of use of the attachment plate can include attachment to a glass such as wine glass, champagne glass etc. at, for example, arrangements with table placing. The attachment plate can be in the form of a card that is attached to a flower stalk, a name tag that is attached to fabric/clothing and so on.

The attachment plate is of a flexible, bendable material such as plastics, metal, paper or cardboard.

Additional advantages and characteristics according to the embodiments of the invention are apparent in view of the patent claims and in the following description of the embodiments.

BRIEF DESCRIPTION OF THE DRAWINGS

The invention is now described in more detail with reference to the appended drawings and the invention is not to be interpreted to be limited to the drawings in which FIG. 1 schematically shows a plane top view of an attachment plate according to the present invention.

DETAILED DESCRIPTION OF PREFERRED EMBODIMENTS

Figure 1:
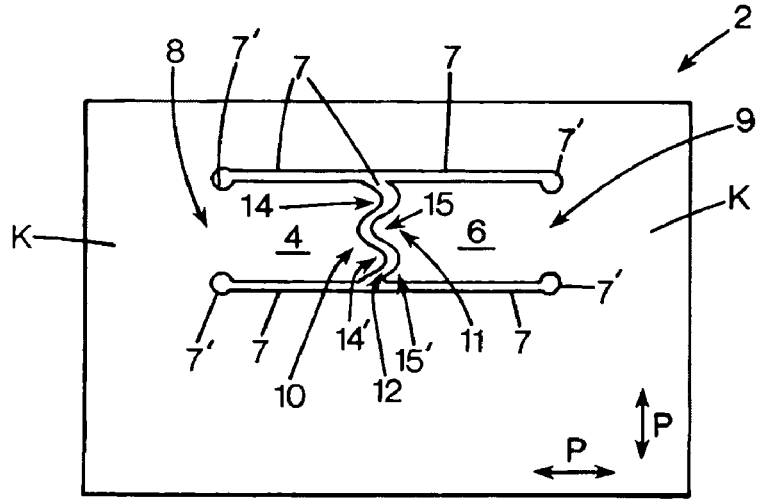

An attachment plate 2 is shown in FIGS. 1–4 according to the embodiments of the present invention. The attachment plate has at least two tongue shaped portions extending in opposite directions, a first tongue 4 and a second tongue 6. The tongue shaped portions 4, 6 are limited by slits 7 of the attachment plate that, when undivided, extend from the edge areas K of the plate and towards one another. The tongue shaped portions are shaped by the perforations of the plate 2 so that a foot portion 8, 9 of each tongue shaped portion 4, 6, respectively, is held to and by the plate 2. The tongue shaped portions 4, 6 are, from the foot portion 8, 9 to an outer free end 10, 11 of each tongue shaped portion flexible and bendable in a direction R (see FIG. 2) across the extension plane P of the plate (see FIGS. 1 and 4). The slits end at an opening 7' at the foot portions 8, 9.

Furthermore, the outer free ends 10, 11 of the tongue shaped portions 4, 5 are immediately adjacent to one another at a slit 12 formed by a perforation. The outer free end 10, 11 of each respective tongue shaped portion is shaped so that it has at least one narrowing portion 14, 15. Each respective narrowing portion 14, 15 is adapted to, at least partially, overlap the other at the slit 12. As shown in FIGS. 1–4 the overlap means that one narrowing portion 14 of the first tongue shaped portion 4 extends toward the foot portion 9 of the opposite second tongue shaped portion 6 and vice versa so that a narrowing portion 15 of the second tongue shaped portion 6 extends towards the foot portion 8 of the first tongue shaped portion 4.

The attachment plate (see FIG. 1) has, according to one embodiment, outer free ends 10, 11 of each tongue shaped portion 4, 6, respectively, that are shaped with at least two narrowing portions 14, 14', 15, 15'. The tongue shaped portion can, when disposed immediately adjacent to one another, form a wave shaped slit, as shown in FIG. 1, along the slits 12.

The attachment plate 2 is of a flexible, bendable material. FIG. 2 shows how the attachment plate, according to FIG. 1, is applied to an item by bending the plate. When bending the entire attachment plate 2, each respective tongue shaped portion is bent in the direction R out from the plate across the extension plane P of the plate (see FIG. 1). In this way, the free ends 10, 11 of the tongue shaped portion, when bending the entire attachment plate in a direction that corresponds with the tongue shaped portions, as opposed to the rest of the plate, are substantially unbent. By forming a gap G between the outer free ends 10, 11, the plate is with its tongue shaped portions fastenable to the bearer, such as the jacket of the person since the flexible plate is permitted to return to its plane extension (see FIG. 1).

Figure 2:
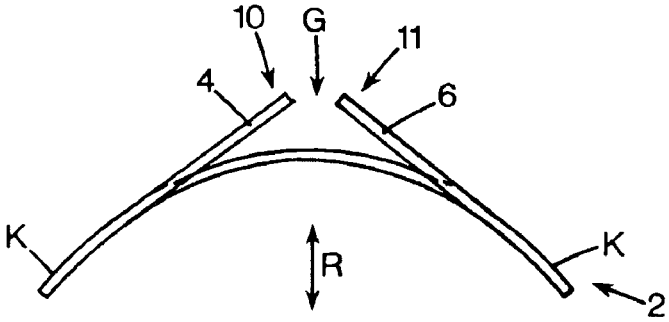
FIG. 2 shows an elevational side view of the attachment plate according to FIG. 1 when the entire attachment plate is bent.
Figure 3:
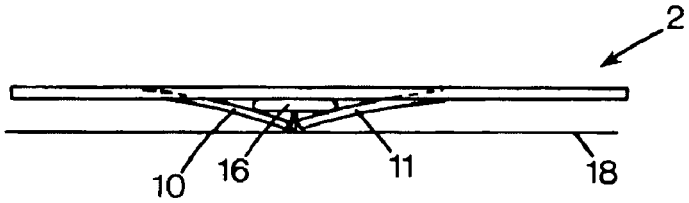
FIG. 3 shows an elevational side view of the attachment plate according to FIG. 1 attached to a button on a fabric.

FIG. 3 shows the attachment plate 2 according to FIGS. 1–2 attached to a button 16 on a fabric 18. The attachment plate is preferably also suitable for attachment to fabric but can also be attached to other soft surfaces of an item and also to thin and narrow portions of items such as sheets or similar items.

Figure 4:
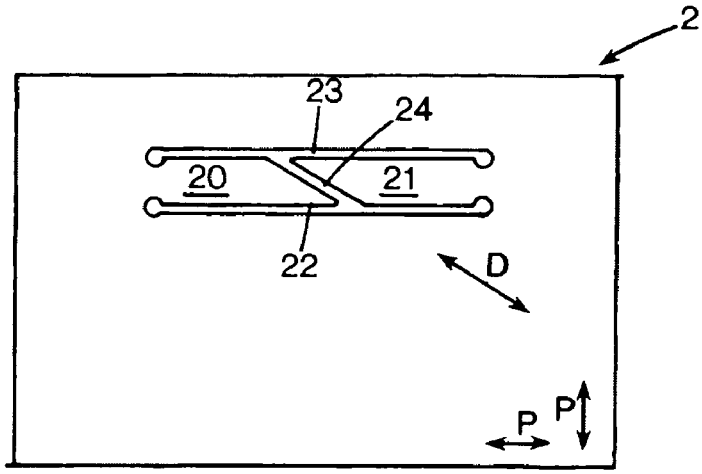
FIG. 4 shows a plane top view of an alternative embodiment of an attachment plate according to the present invention.

FIG. 4 shows an alternative embodiment of the tongue shaped portions 20, 21 for the attachment plate 2 according to the present invention that can be particularly suitable for attaching the attachment plate to elongate items such as cables, blower stalks or similar items. This attachment plate is characterized in that the outer free end 22, 23 of each tongue shaped portion 20, 21, respectively, is formed with a continuously narrowing portion so that the formed slits 24 has a substantially straight, diagonal extension D, i.e. diagonal relative to the direction of the extending tongue shaped portions.

What is claimed is:

1. An attachment plate of a flexible, bendable material comprising:

two tongue shaped portions including a first tongue and a second tongue, a foot portion of the first tongue and a foot portion of the second tongue held to the plate while each respective tongue, extending from the foot portion to an outer free end of each tongue, respectively, is outwardly bendable from the plate and the outer free ends of the first tongue and the second tongue are immediately adjacent to one another at a slit formed by a perforation, the outer free end of each respective tongue having at least one narrowing portion, the first tongue facing the second tongue so that the foot portion of the first tongue is disposed at one end of the attachment plate and the foot portion of the second tongue is disposed at an opposite end of the attachment plate, the outer free end of the first tongue having a first cavity defined therein, the outer free end of the second tongue having a second cavity defined therein, a protrusion of a portion of the outer free end of the second tongue extending into the first cavity, a protrusion of a portion of the outer free end of the first tongue extending into the second cavity, the attachment plate and the attachment plate having first side-slits defined therebetween and extending along each side of the first tongue from the foot portion of the first tongue to the outer free end at the slit formed by a perforation, the attachment plate and the attachment plate having second side-slits defined therebetween and extending along each side of the second tongue from the foot portion of the second tongue to the outer free end at the slit formed by a perforation, and the first side-slits being parallel to and aligned with the second side-slits.

2. The attachment plate according to claim 1 wherein the outer free end of each respective tongue shaped portion has at least two narrowing portions.

3. The attachment plate according to claim 1 wherein the slit formed by a perforation is wave shaped.

4. An attachment plate of a bendable material, comprising:

a first tongue and a second tongue formed by a weakened segment, in the attachment plate so that a first foot portion of the first tongue and a second foot portion of the second tongue are being held to the attachment plate;

the first tongue extending from the first foot portion to a first outer free end;

the second tongue extending from the second foot portion to a second outer free end;

the attachment plate is bendable relative to the first and second tongues;

the first outer free end being adjacent to the second free end at a slit formed by the weakened segment, the first tongue facing the second tongue so that the first foot portion is disposed at one end of the attachment plate and the second foot portion is disposed at an opposite end of the attachment plate, the outer free end of the first tongue having a first cavity defined therein, the outer free end of the second tongue having a second cavity defined therein, a protrusion of a portion of the outer free end of the second tongue extending into the first cavity, a protrusion of a portion of the outer free end of the first tongue extending into the second cavity, the attachment plate and the attachment plate having first side-slits defined therebetween and extending along each side of the first tongue from the first foot portion to the outer free end of the first tongue;

the attachment plate and the attachment plate having second side-slits defined therebetween and extending along each side of the second tongue from the second foot portion to the outer free end of the second tongue, and the first side-slits being parallel to and aligned with the second side-slits.

5. The attachment plate according to claim 4 wherein the outer free end of the first tongue has a first narrowing outer end and the outer free end of the second tongue has a second narrowing outer end.

6. The attachment plate according to claim 5 wherein the first narrowing outer end extends into the second cavity.

7. The attachment plate according to claim 5 wherein the outer free end of the first tongue overlaps the outer free end of the second tongue.

8. The attachment plate according to claim 4 wherein the first tongue extends in a first direction and the second tongue extends in a second direction opposite the first direction.

9. The attachment plate according to claim 4 wherein the outer free end of the first tongue is separable from the outer free end of the second tongue when the attachment plate is in a bent position.

10. The attachment plate according to claim 4 wherein the outer free end of the first tongue has a first protruding portion and the outer free end of the second tongue has a second protruding portion terminating formed by a perforation.

* * * * *